US010343415B2

(12) United States Patent
Yoda et al.

(10) Patent No.: US 10,343,415 B2
(45) Date of Patent: Jul. 9, 2019

(54) INKJET HEAD AND INKJET RECORDING DEVICE INCLUDING INK CHAMBER WITH SEPARATED PORTIONS

(71) Applicant: KONICA MINOLTA, INC., Chiyoda-ku, Tokyo (JP)

(72) Inventors: Mitsuhiro Yoda, Hachioji (JP); Yuichi Machida, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/578,066

(22) PCT Filed: May 26, 2016

(86) PCT No.: PCT/JP2016/065606

§ 371 (c)(1),
(2) Date: Nov. 29, 2017

(87) PCT Pub. No.: WO2016/194776

PCT Pub. Date: Dec. 8, 2016

(65) Prior Publication Data

US 2018/0154653 A1 Jun. 7, 2018

(30) Foreign Application Priority Data

May 29, 2015 (JP) ..... 2015-109611

(51) Int. Cl.
*B41J 2/14* (2006.01)
*B41J 2/21* (2006.01)
(Continued)

(52) U.S. Cl.
CPC ..... *B41J 2/2103* (2013.01); *B41J 2/14* (2013.01); *B41J 2/145* (2013.01); *B41J 2/14201* (2013.01); *B41J 2/17513* (2013.01)

(58) Field of Classification Search
CPC .. B41J 2/2103; B41J 2/17513; B41J 2/14201; B41J 2/145; B41J 2/14
See application file for complete search history.

(56) References Cited

U.S. PATENT DOCUMENTS

2006/0197809 A1* 9/2006 Tobita ..... B41J 2/14274 347/71
2015/0042726 A1 2/2015 Enomoto et al.

FOREIGN PATENT DOCUMENTS

CN 104228351 A 12/2014
EP 2594401 A1 5/2013
(Continued)

OTHER PUBLICATIONS

Extended European Search Report corresponding to Application No. 16803211.8-1019/3305528 PCT/JP2016065606; dated May 4, 2018.

(Continued)

*Primary Examiner* — Bradley W Thies
(74) *Attorney, Agent, or Firm* — Cantor Colburn LLP

(57) ABSTRACT

An object of the present invention is to provide an inkjet head and the like in which an ink chamber can be separated by a simple structure with high accuracy. An inkjet head according to the present invention includes: a head chip including a plurality of nozzles that ejects inks, a plurality of pressure chambers respectively in communication with the plurality of nozzles, and a piezoelectric element that generates pressure change inside each of the plurality of pressure chambers to eject an ink; an ink chamber to store an ink; and a holding portion that is jointed to an ink supply hole forming surface of the head chip and holds the ink chamber. The holding portion is characterized in including: an outer peripheral wall holding portion to hold an outer peripheral wall of the ink chamber; and a separation wall holding portion to hold a separation wall of the ink chamber, and the (Continued)

ink chamber is separated into a plurality of portions by the separation wall and the separation wall holding portion.

20 Claims, 14 Drawing Sheets

(51) Int. Cl.
*B41J 2/145* (2006.01)
*B41J 2/175* (2006.01)

(56) References Cited

FOREIGN PATENT DOCUMENTS

| | | | |
|---|---|---|---|
| JP | 05338178 | A | 12/1993 |
| JP | H10510492 | A | 10/1998 |
| JP | 2003260792 | A | 9/2003 |
| JP | 2012126029 | A | 7/2012 |

OTHER PUBLICATIONS

International Search Report corresponding for Application No. PCT/JP2016/065606; dated Aug. 9, 2016.
Written Opinion of the International Searching Authority for corresponding Application No. PCT/JP2016/065606; dated Aug. 9, 2016.
SIPO First Office Action corresponding to CN Application No. 201680029833.8; dated Oct. 16, 2018.

* cited by examiner

INKJET HEAD AND INKJET RECORDING DEVICE INCLUDING INK CHAMBER WITH SEPARATED PORTIONS

CROSS REFERENCE TO RELATED APPLICATIONS

This is the U.S national stage of application No. PCT/JP2016/065606, filed on May 26, 2016. Priority under 35 U.S.C § 119(a) and 35 U.S.C. § 365(b) is claimed from Japanese Applications No. 2015-109611, filed May 29, 2015, the disclosure of which is incorporated herein by reference.

TECHNICAL FIELD

The present invention relates to an inkjet head and an inkjet recording device.

BACKGROUND ART

In the related art, there is a known inkjet recording device that ejects ink droplets from a plurality of nozzles provided at an inkjet head to form an image on a recording medium. Additionally, in recent years, the number of nozzles provided at an inkjet head is increased due to achievement of higher accuracy and higher speed in image forming by an inkjet recording device, and there is a known inkjet head in which positions of a large number of nozzles are determined with high accuracy. Furthermore, particularly, in an inkjet recording device that performs color printing, a plurality of inkjet heads of multiple colors corresponding to, for example, cyan, magenta, yellow, black, and the like is respectively mounted, and therefore, there is a problem that a device size tends to be enlarged.

In contrast, for example, there is a known inkjet head that can print inks of multiple colors by one inkjet head. This can reduce the number of inkjet heads and the like required for a device, and therefore, the inkjet head recording device can be downsized. Furthermore, since the number of inkjet heads for which position adjustment is to be performed can be reduced, it is possible to reduce labor at the time of mounting the inkjet head.

As an example of the inkjet head that can print inks of multiple colors, disclosed is an inkjet head in which arrays of a large number of nozzle holes corresponding to four colors of cyan, magenta, yellow, and black are provided on a head chip, and each array of the nozzle holes of each color is in communication with an ink supply channel of each color (Patent Literature 1).

CITATION LIST

Patent Literature

Patent Literature 1: JP 5-338178 A

SUMMARY OF INVENTION

Technical Problem

Incidentally, in the case of forming a simpler structure of a head chip in an inkjet head that can eject inks of multiple colors, provided is a structure in which an ink is supplied from an ink supply hole provided above a pressure chamber in a vertical direction in order to supply the ink to the pressure chamber corresponding to each nozzle. Here, in the case where nozzles are provided at a narrow pitch on the head chip, ink supply holes are also provided at a narrow pitch and an interval between the ink supply holes is narrowed, and therefore, it is difficult to provide separated ink chambers on the head chip.

In the inkjet head as disclosed in Patent Literature 1, since an ink supply channel (ink chamber) is needed to be directly bonded to the head chip, there may be problems in that: the ink supply channels are needed to be bonded after positions thereof are accurately determined in a manner corresponding to the ink supply holes arranged at a narrow pitch; and separation into multiple colors is difficult in terms of accuracy.

The present invention has been made in view of the above-described problems, and provides an inkjet head and an inkjet recording device in which an ink chamber can be separated by a simple structure with high accuracy.

Solution to Problem

To solve the above-described problems, the invention according to claim 1 is an inkjet head characterized in including:

a head chip including: a plurality of nozzles that ejects inks; a plurality of pressure chambers respectively in communication with the plurality of nozzles; and a pressure generation unit that causes the nozzle to eject an ink by generating pressure change inside each of the plurality of pressure chambers;

an ink chamber to store inks to be supplied to the plurality of pressure chambers;

a holding portion that is joined to an ink supply hole forming surface and holds the ink chamber, the ink supply hole forming surface being formed with an ink supply hole and located on an opposite side of a surface where the plurality of nozzles of the head chip is formed, in which the holding portion includes an outer peripheral wall holding portion that holds an outer peripheral wall of the ink chamber, and a separation wall holding portion that holds a separation wall of the ink chamber, and the ink chamber is separated into a plurality of portions by the separation wall and the separation wall holding portion.

The invention according to claim 2 in the inkjet head according to claim 1 is characterized in that the separation wall holding portion has a surface joined to the separation wall having an area larger than an area of a surface joined to the ink supply hole forming surface.

The invention according to claim 3 in the inkjet head according to claim 2 is characterized in that the separation wall holding portion is formed to become larger stepwisely from the surface joined to the ink supply hole forming surface toward the surface joined to the separation wall.

The invention according to claim 4 in the inkjet head according to any one of claims 1 to 3 is characterized in that the outer peripheral wall holding portion includes: a first spacer portion joined to the ink supply hole forming surface; and an outer peripheral wall supporting portion joined to the first spacer portion and supporting the outer peripheral wall, and the separation wall holding portion includes: a second spacer portion joined to the ink supply hole forming surface; and a separation wall supporting portion joined to the second spacer portion and supporting the separation wall.

The invention according to claim 5 in the inkjet head according to claim 4 is characterized in that the first spacer portion and the second spacer portion are integrally molded.

The invention according to claim 6 in the inkjet head according to claim 4 or 5 is characterized in that the first spacer portion and the second spacer portion are thinner than the outer peripheral wall supporting portion and the separation wall supporting portion.

The invention according to claim 7 in the inkjet head according to any one of claims 1 to 6 is characterized in that the ink supply holes are arrayed on the ink supply hole forming surface in a manner such that respective row intervals become equal intervals.

The invention according to claim 8 in the inkjet head according to any one of claims 4 to 6 is characterized in that the first spacer portion and the second spacer portion are made of silicon, a 42 alloy, or SUS.

The invention according to claim 9 in the inkjet head according to any one of claims 1 to 8 is characterized in that the ink chamber is separated into a plurality of portions including at least a first ink chamber and a second ink chamber, and an ink stored in the first ink chamber and an ink stored in the second ink chamber are different.

The invention according to claim 10 is an inkjet recording device including the inkjet head according to any one of claims 1 to 9.

Advantageous Effects of Invention

According to the present invention, the ink chamber can be separated by a simple structure with high accuracy in the inkjet head that can eject inks of multiple colors.

DESCRIPTION OF EMBODIMENTS

Figure 1:
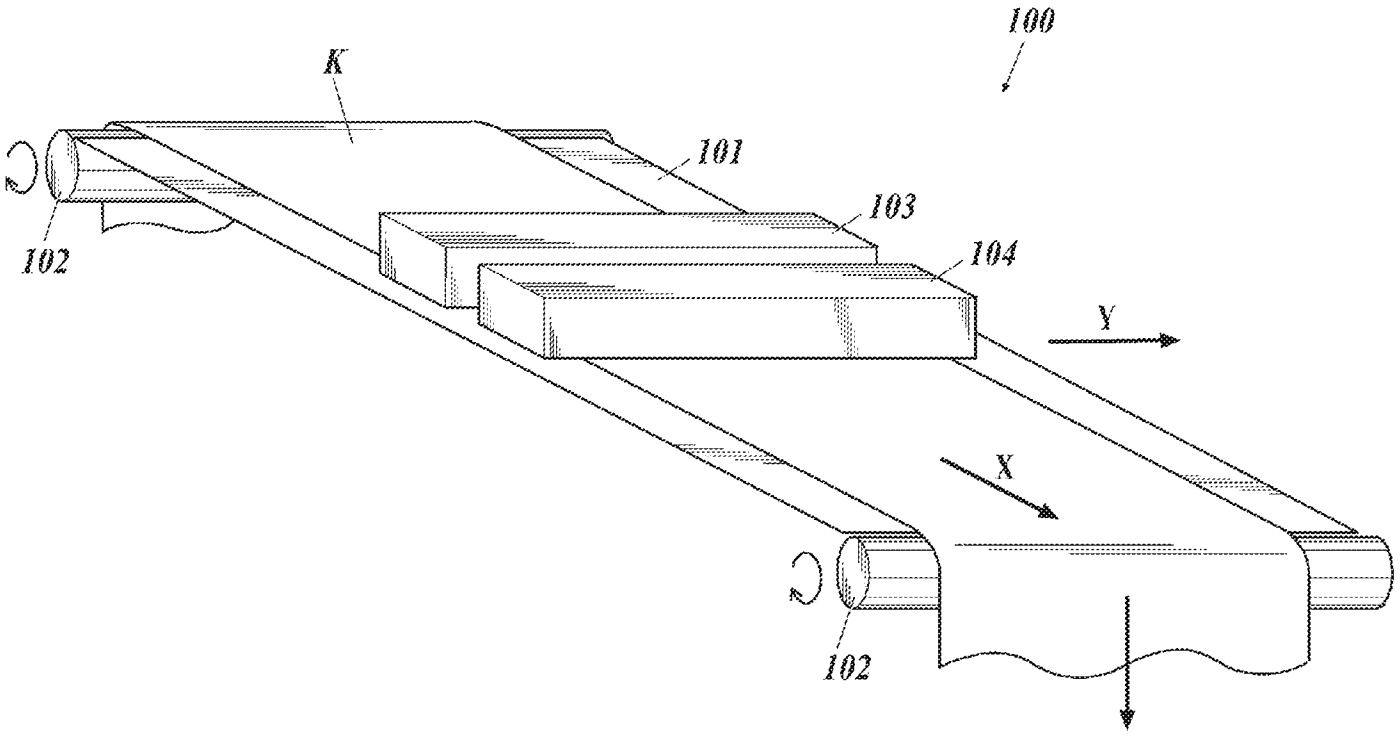
FIG. 1 is a perspective view illustrating a schematic structure of an inkjet recording device.

In the following, preferred embodiments of the present invention will be described with reference to the drawings. Note that the scope of the invention is not limited to examples illustrated in the drawings. Additionally, in the following description, a component having a same function and a same structure will be denoted by a same reference sign, and a description therefor will be omitted.

Meanwhile, in the following description, the description will provided by exemplifying an embodiment in a single-pass rendering method whereby rendering is performed by only conveyance of a recording medium by using a line head, but the present invention is applicable to any suitable rendering method, and for example, a rendering method using a scan system or a drum system may also be adopted.

[Outline of Inkjet Recording Device]

An inkjet recording device 100 includes a platen 101, a conveyance roller 102, line heads 103 and 104, and the like (FIG. 1).

The platen 101 supports a recording medium K on an upper surface thereof, and conveys the recording medium K in a conveying direction (X direction) when the conveyance roller 102 is driven.

The line heads 103 and 104 are provided in parallel in a width direction orthogonal to the conveying direction from an upstream side to a downstream side in the conveying direction of the recording medium K. Additionally, at least one inkjet head 1 is provided inside each of the line heads 103 and 104, and ejects inks of, for example, cyan (C), magenta (M), yellow (Y), and black (K) toward the recording medium K.

Furthermore, the inkjet head 1 capable of ejecting inks of two colors is provided in each of the line heads 103 and 104. Additionally, for example, at least one inkjet head 1 capable of ejecting inks of cyan (C) and magenta (M) is provided in the line head 103, and at least one inkjet head 1 capable of ejecting inks of yellow (Y) and black (K) is provided in the line head 104.

[Inkjet Head Portion]

A structure of the inkjet head 1 will be described with reference to FIGS. 2 to 11.

Note that, in the following description, a plane provided with a plurality of nozzles 11 will be defined as an X-Y plane, and directions parallel to the plane and orthogonal to each other will be defined as an X direction and a Y direction respectively. Additionally, note that a direction orthogonal to the X-Y plane will be defined as a Z direction. Furthermore, note that a pointing side of an arrow in the X direction will be defined as a downstream side in the X direction, and a side opposite to the pointing side will be defined as an upstream side in the X direction.

Figure 2A:
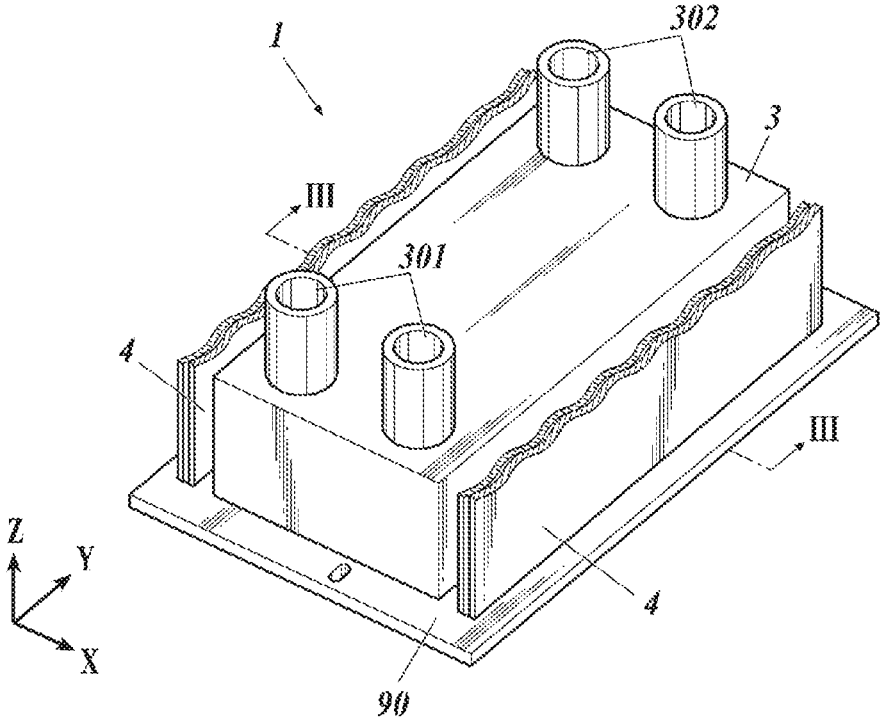
FIG. 2A is a perspective view of an inkjet head from above.
Figure 2B:
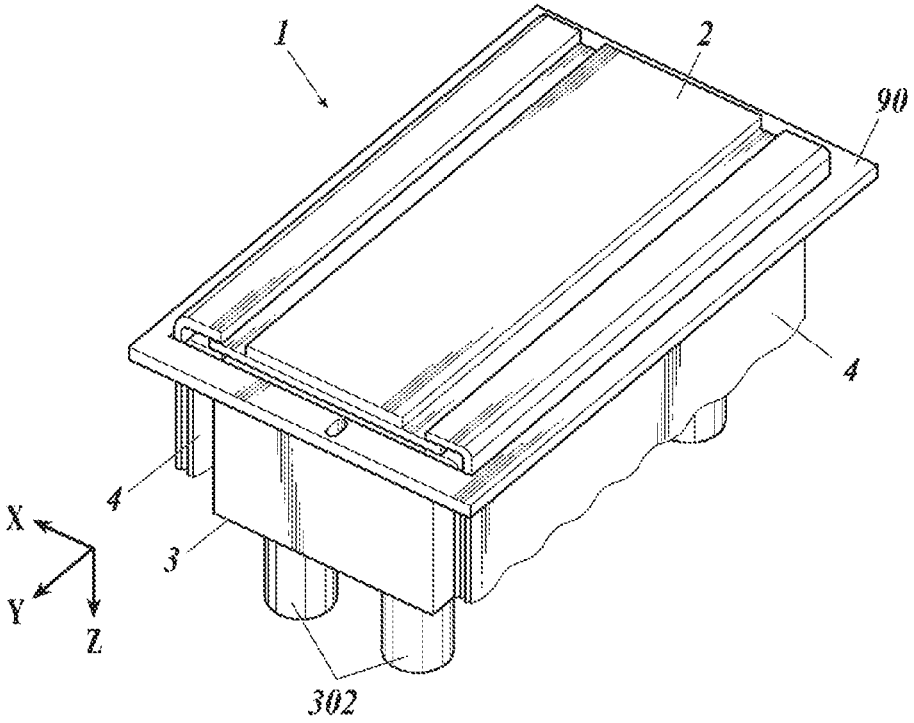
FIG. 2B is a perspective view of the inkjet head from below.
Figure 3:
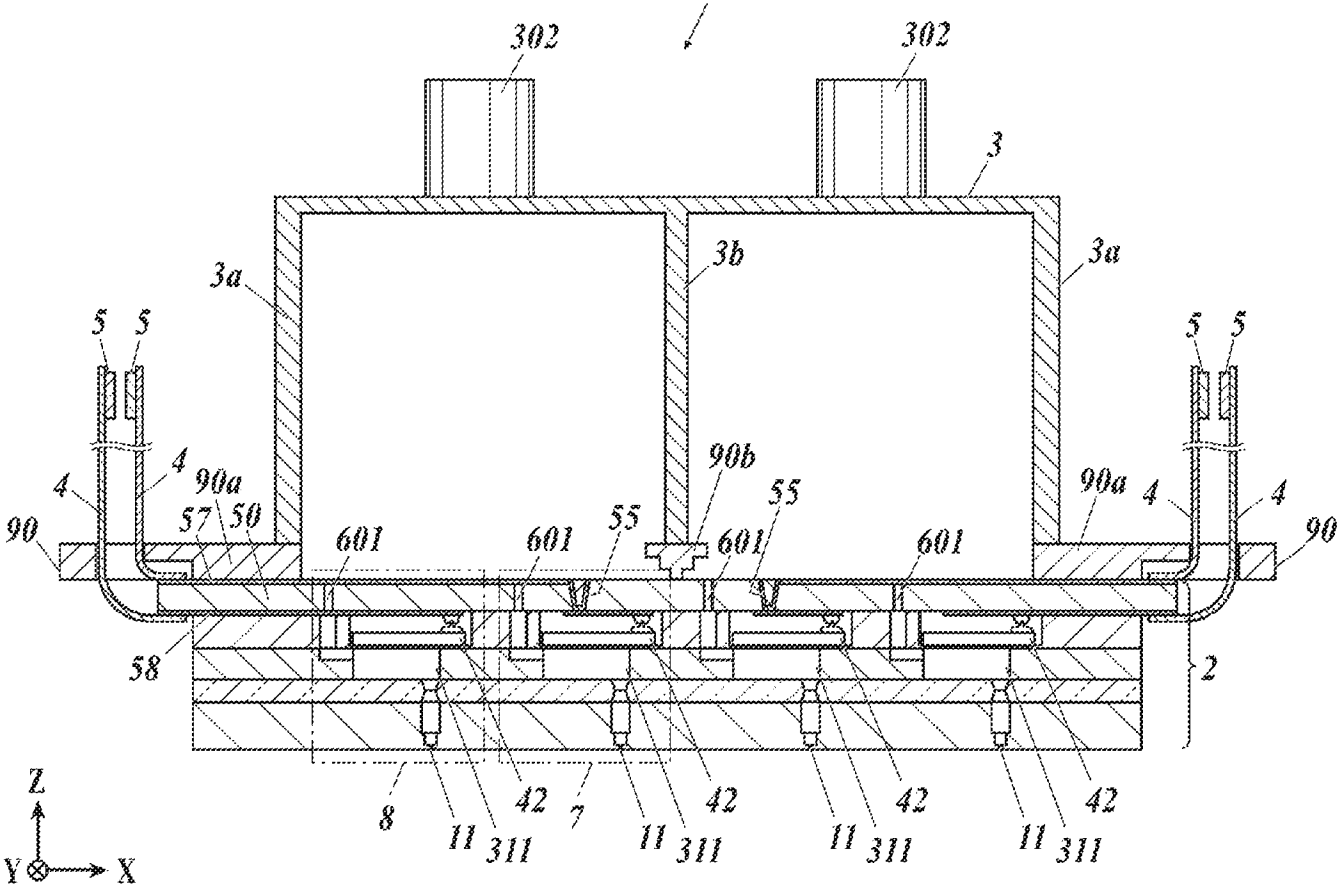
FIG. 3 is a cross-sectional view illustrating a main portion of a cross section taken along a line in FIG. 2A.

The inkjet head 1 includes a head chip 2, a holding portion 90, an ink chamber 3, a connecting member 4, and the like (refer to FIGS. 2A, 2B, and 3, and the like).

Figure 10:
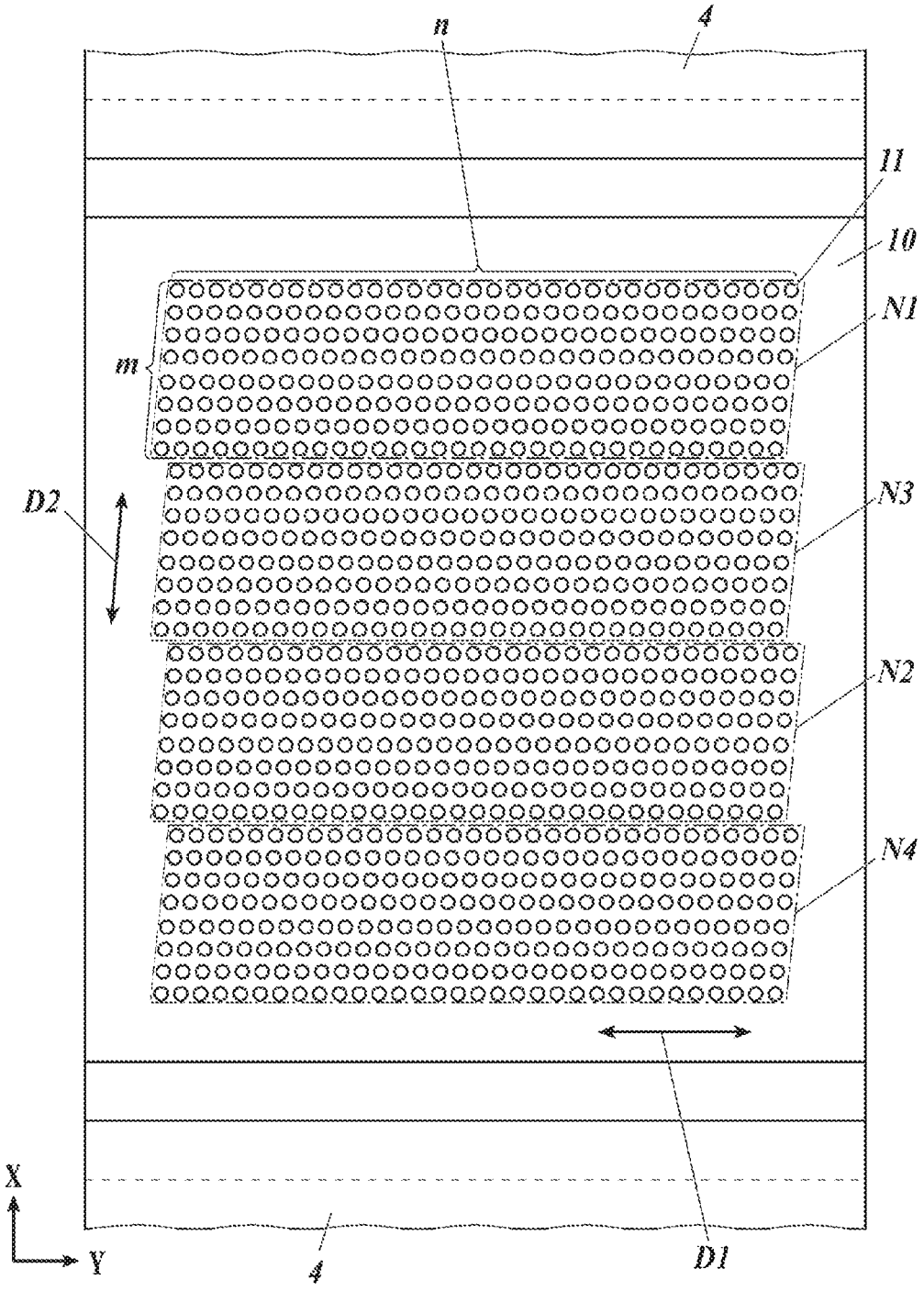
FIG. 10 is a bottom view of a nozzle substrate.

The head chip 2 is formed by stacking a plurality of substrates in the Z direction, and a large number of nozzles 11 to eject inks are densely provided on a substrate at a lowermost layer (refer to FIG. 10). Furthermore, a pressure chamber 311 filled with an ink and a piezoelectric element 42 serving as a pressure generation unit are provided inside the head chip 2 in a manner corresponding to each of the nozzles 11. Additionally, a large number of ink supply holes 601 are densely provided, in a manner corresponding to these pressure chambers 311, on a wiring substrate 50 that is an uppermost layer of the head chip 2 (refer to FIGS. 4 to 6), and an ink is supplied from the ink chamber 3 to each of the pressure chambers 311 via each of the ink supply holes 601. Then, the ink filled in the pressure chamber 311 is pressurized by displacement of the piezoelectric element 42, and ink droplets are ejected from the nozzle 11.

The ink chamber 3 is separated into two portions by outer peripheral walls 3*a*, a separation wall 3*b*, and the holding portion 90, and two colors out of cyan (C), magenta (M), yellow (Y) and black (K) are filled into the separated portions of the ink chamber 3 color by color. Then, the inks are supplied from the two separated portions of the ink chamber 3 to pressure chambers 311 provided at ink ejection units 7 and 8 inside the head chip 2 through ink supply holes 601 provided at an uppermost surface of the head chip 2.

Additionally, an ink supply unit 301 adapted to supply an ink to the ink chamber 3 and an ink discharge unit 302 adapted to discharge an ink of the ink chamber 3 (refer to FIG. 2A) are provided in each of the two separated portions of the ink chamber 3.

The connecting member 4 is a wiring member connected to a drive unit 5 made of, for example, an FPC or the like, and connected to a first wire 57 passing through a through electrode 55 on an upper surface of the wiring substrate 50 of the head chip 2 or to a second wire 58 on a lower surface of the wiring substrate 50. Additionally, power is supplied to the piezoelectric element 42 from the drive unit 5 through the connecting member 4 and the first wire 57 or the second wire 58. Here, the connecting member 4 connected to the lower surface of the wiring substrate 50 is routed to an upper surface of the holding portion 90 from a through hole of the holding portion 90 opened in the vicinity of an end portion in the X direction of the wiring substrate 50.

[Holding Portion]

The holding portion 90 is formed of: an outer peripheral wall holding portion 90*a* to hold the outer peripheral wall 3*a* of the ink chamber 3; and a separation wall holding portion 90*b* to hold the separation wall 3*b* that separates the ink chamber 3 into two portions (refer to FIG. 3 and the like). Consequently, the holding portion 90 is provided on an upper surface of the head chip 2 by performing position adjustment, and then the outer peripheral wall 3*a* and the separation wall 3*b* of the ink chamber 3 can be provided by using the holding portion 90 as a mark. Therefore, the ink chamber 3 can be separated by a simple structure with high accuracy.

The separation wall holding portion 90*b* has a surface joined to the separation wall 3*b* having an area that is larger than an area of a surface joined to an ink supply hole forming surface 600. Consequently, since the surface joined to the separation wall 3*b* can be formed larger, reliability of the joined surface can be improved.

Figure 4:
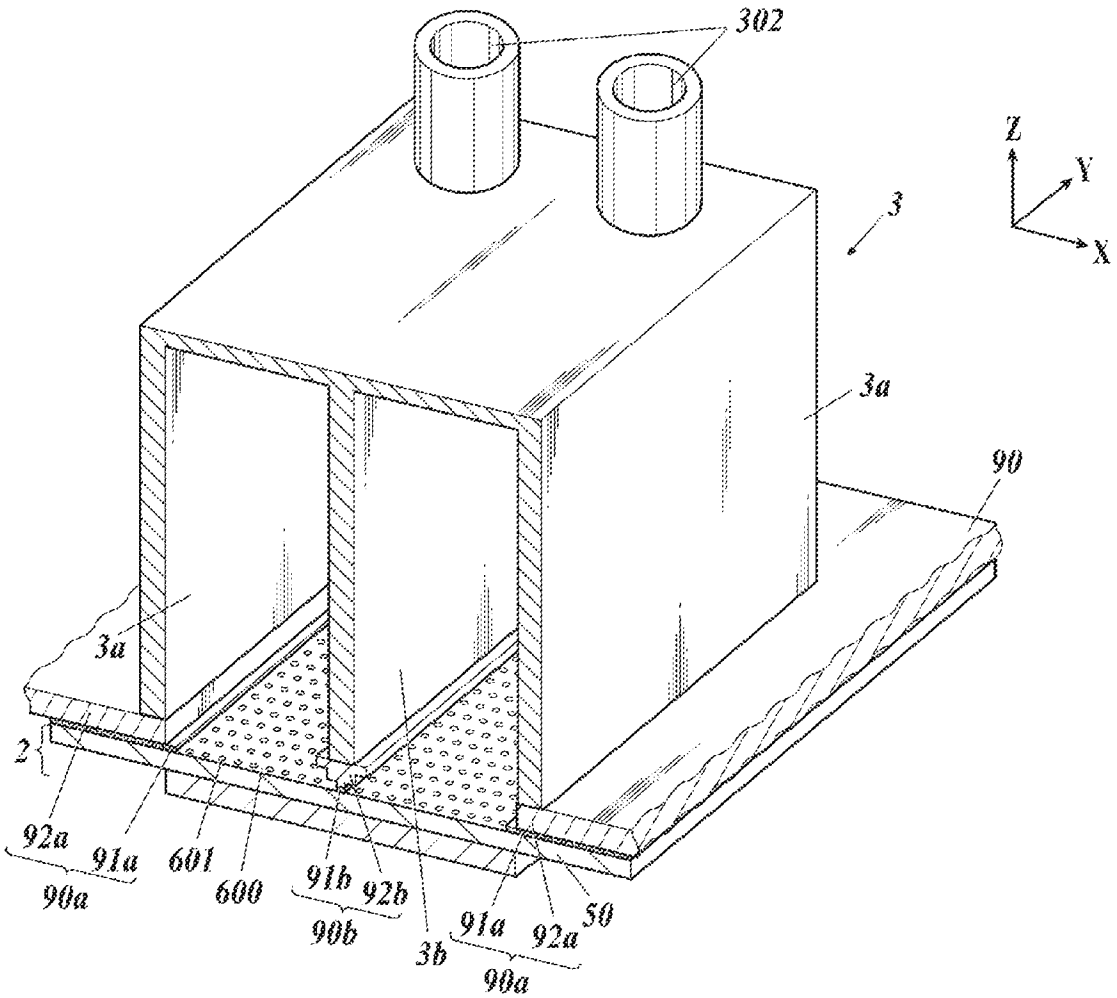
FIG. 4 is a perspective view illustrating the cross section of FIG. 3.
Figure 5:
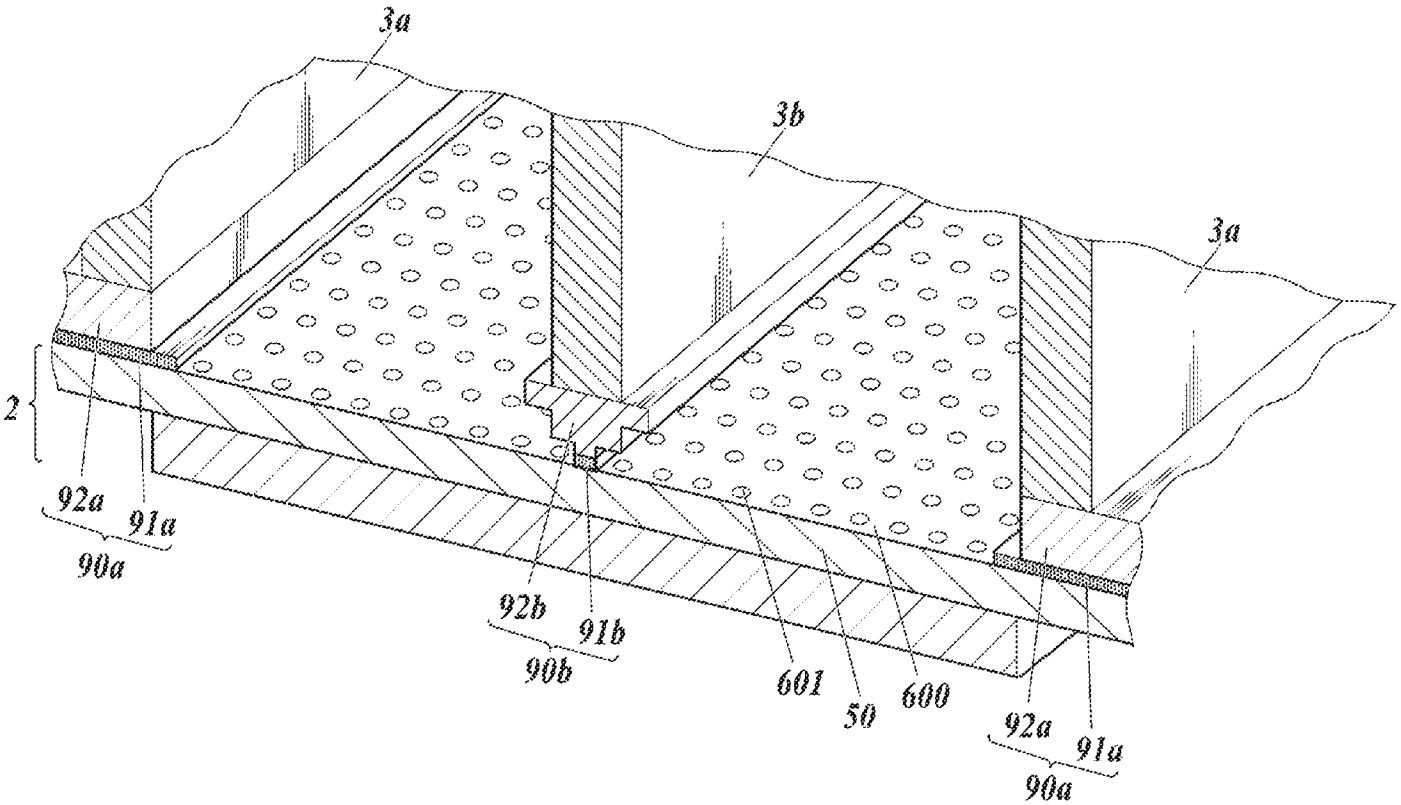
FIG. 5 is an enlarged view of the main portion in FIG. 4.

Additionally, the separation wall holding portion 90*b* is formed to become larger stepwisely from the surface joined to the ink supply hole forming surface 600 toward the surface joined to the separation wall 3*b* (refer to FIGS. 3 to 5 and the like). Consequently, not only the surface joined to the separation wall 3*b* can be formed larger but also a larger space can be secured in the vicinity of an ink supply hole 601. Therefore, flow path resistance in the vicinity of the separation wall holding portion 90*b* can be prevented from being increased, and pressure applied to an ink supply hole 601 provided near the separation wall holding portion 90*b* and an ink supply hole 601 distant from the separation wall holding portion 90*b* can be uniformly dispersed. Accordingly, it is possible to stably supply inks to all of the ink supply holes 601 from the ink chamber 3.

Incidentally, while the separation wall holding portion 90*b* preferably has a stepwise form from the viewpoint of manufacturing efficiency, the form can be changed as far as the surface joined to the separation wall 3*b* has the area larger than the area of the surface joined to the ink supply hole forming surface 600. For example, there may be a form in which a cross-sectional area of the separation wall holding portion 90*b* in the X-Y plane is gradually increased from the surface joined to the ink supply hole forming surface 600 toward the surface joined to the separation wall 3*b*.

The outer peripheral wall holding portion 90*a* is formed of: a first spacer portion 91*a* joined to the uppermost surface of the head chip 2 (ink supply hole forming surface 600); and an outer peripheral wall supporting portion 92*a* joined to the first spacer portion 91*a* and supporting the outer peripheral wall 3*a* (refer to FIGS. 4 and 5 and the like). Additionally, the separation wall holding portion 90*b* is formed of: a second spacer portion 91*b* joined to the uppermost surface of the head chip 2 (ink supply hole forming surface 600); and a separation wall supporting portion 92*b* joined to the second spacer portion 91*b* and supporting the separation wall 3*b*.

Consequently, the ink chamber 3 can be provided on the upper surface of the head chip 2 with higher accuracy because the first spacer portion 91*a* and the second spacer portion 91*b* are provided on the upper surface of the head chip 2 by performing position adjustment, and then the outer peripheral wall supporting portion 92*a* and the separation wall supporting portion 92*b* are provided by using the first spacer portion 91*a* and the second spacer portion 91*b* as markers, and finally the ink chamber 3 can be provided.

Figure 6:
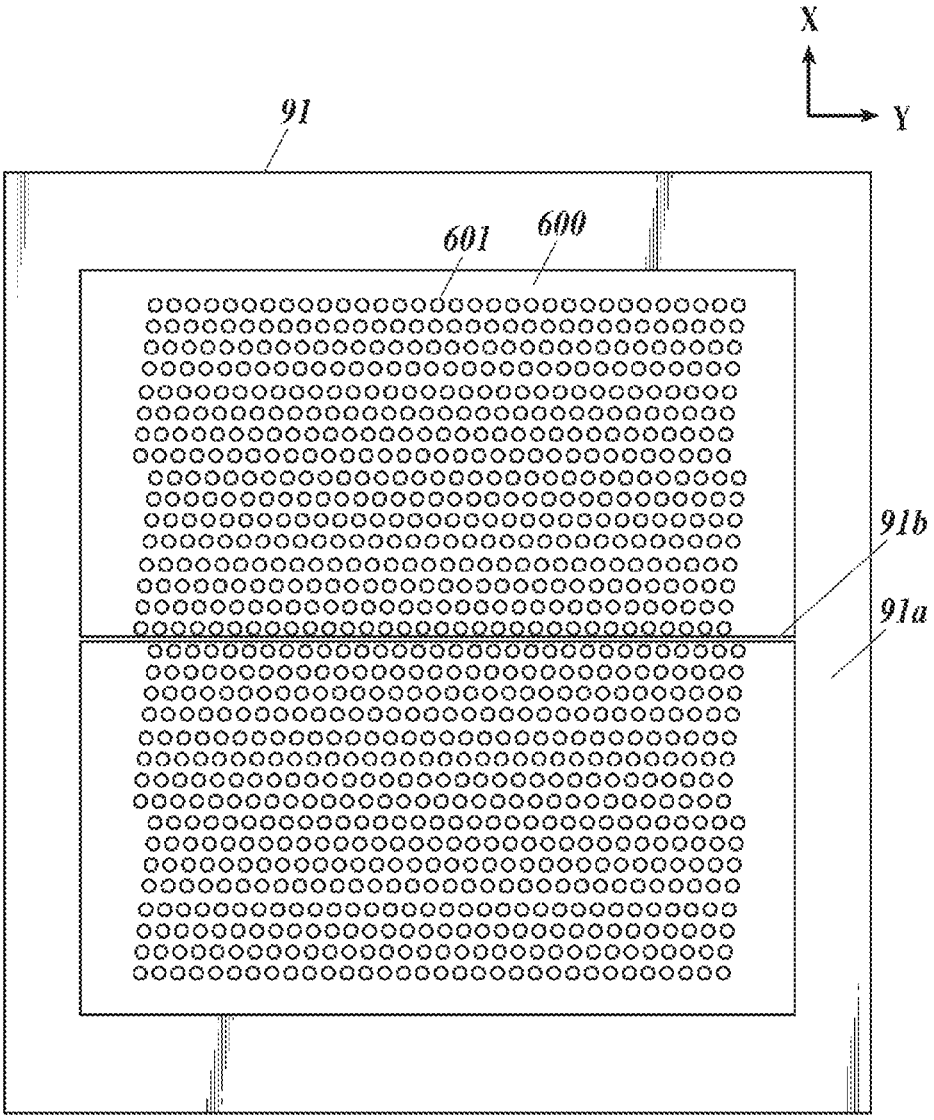
FIG. 6 is a plan view illustrating a positional relation between a spacer portion and an ink supply hole forming surface.

Additionally, the first spacer portion 91*a* and the second spacer portion 91*b* are integrally molded as illustrated in FIG. 6. (Note that the "first spacer portion 91*a* and second spacer portion 91*b*" may also be collectively referred to as "spacer portion 91" in the following.) Consequently, a structure in which ink leakage hardly occurs can be achieved because the spacer portion 91 having a uniform height in the Z direction can be formed relative to an entire surface of the upper surface of the head chip 2 (ink supply hole forming surface 600).

Furthermore, from the viewpoint of performing position adjustment with high accuracy, the spacer portion 91 is joined to the head chip 2 by, preferably, providing an alignment mark (not illustrated) in each of the spacer portion 91 and the head chip 2 and joining these component after determining respective positions thereof.

Additionally, from the viewpoint of performing position adjustment with high accuracy, the spacer portion 91 preferably has a thickness in the Z direction smaller than thicknesses of the outer peripheral wall supporting portion 92*a* and separation wall supporting portion 92*b*, and specifically, the thickness is preferably 0.05 to 0.5 mm, and more preferably, 0.1 to 0.3 mm. Since the thickness is set to 0.5 mm or less, it is possible to obtain the spacer portion 91 having high processing accuracy, and positional adjustment can be performed with high accuracy. Also, sufficient strength can achieved as a spacer by setting the thickness to 0.05 mm or more.

Furthermore, a material forming the spacer portion 91 is not particularly limited, but it is preferable to use a material having a thermal expansion coefficient close to that of a material forming the head chip 2. Specifically, in the case where a substrate of the upper surface of the head chip 2 is formed of silicon, the spacer portion 91 is preferably formed of silicon, a 42 alloy, glass, or the like. Additionally, among these materials, using the 42 alloy is particularly preferable from the viewpoints of ink resistance, strength, and heat resistance. Furthermore, in the case where the substrate of the upper surface of the head chip 2 is formed of SUS, the spacer portion 91 is preferably formed of SUS.

Additionally, as a positional relation between the spacer portion 91 and the ink supply hole forming surface 600 is illustrated in FIG. 6, the ink supply holes 601 are formed on the ink supply hole forming surface 600 at equal row intervals with respect to the X direction in a manner corresponding to nozzle arrangement described later (refer to FIG. 10). Additionally, the second spacer portion 91*b* is formed in a manner passing in the Y direction between the rows of the ink supply holes arranged at equal row intervals. With this structure, the ink chamber 3 can be separated by providing the separation wall holding portion 90*b* and the separation wall 3*b* in the head chip 2 for one color use.

Additionally, the holding portion 90 has an area larger than an area of the head chip 2 on the X-Y plane, and heat around the head chip 2 can be suitably dissipated.

[Structure of Ink Ejection Unit]

Figure 7:
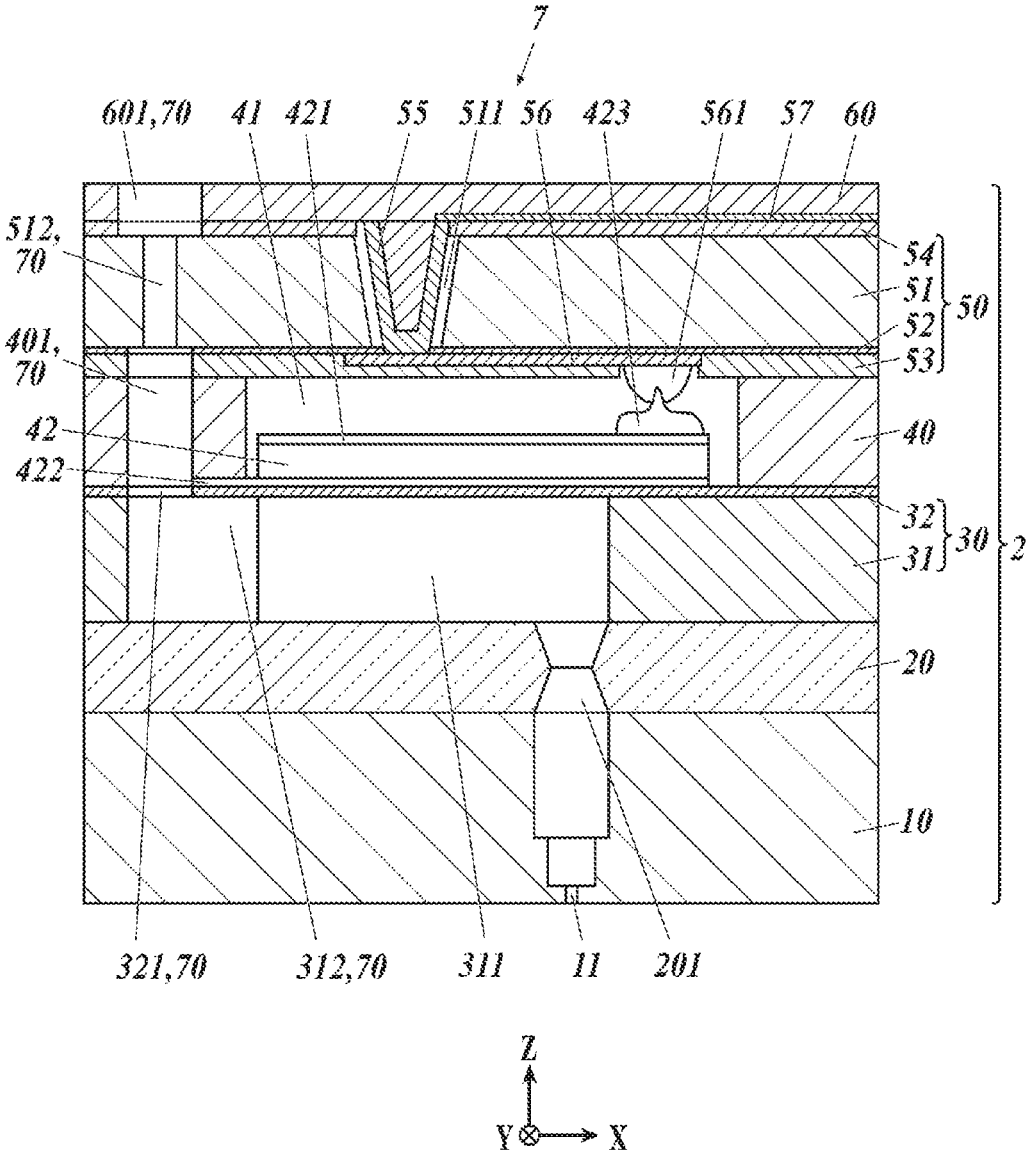
FIG. 7 is a cross-sectional view of an ink ejection unit including a through electrode.
Figure 8:
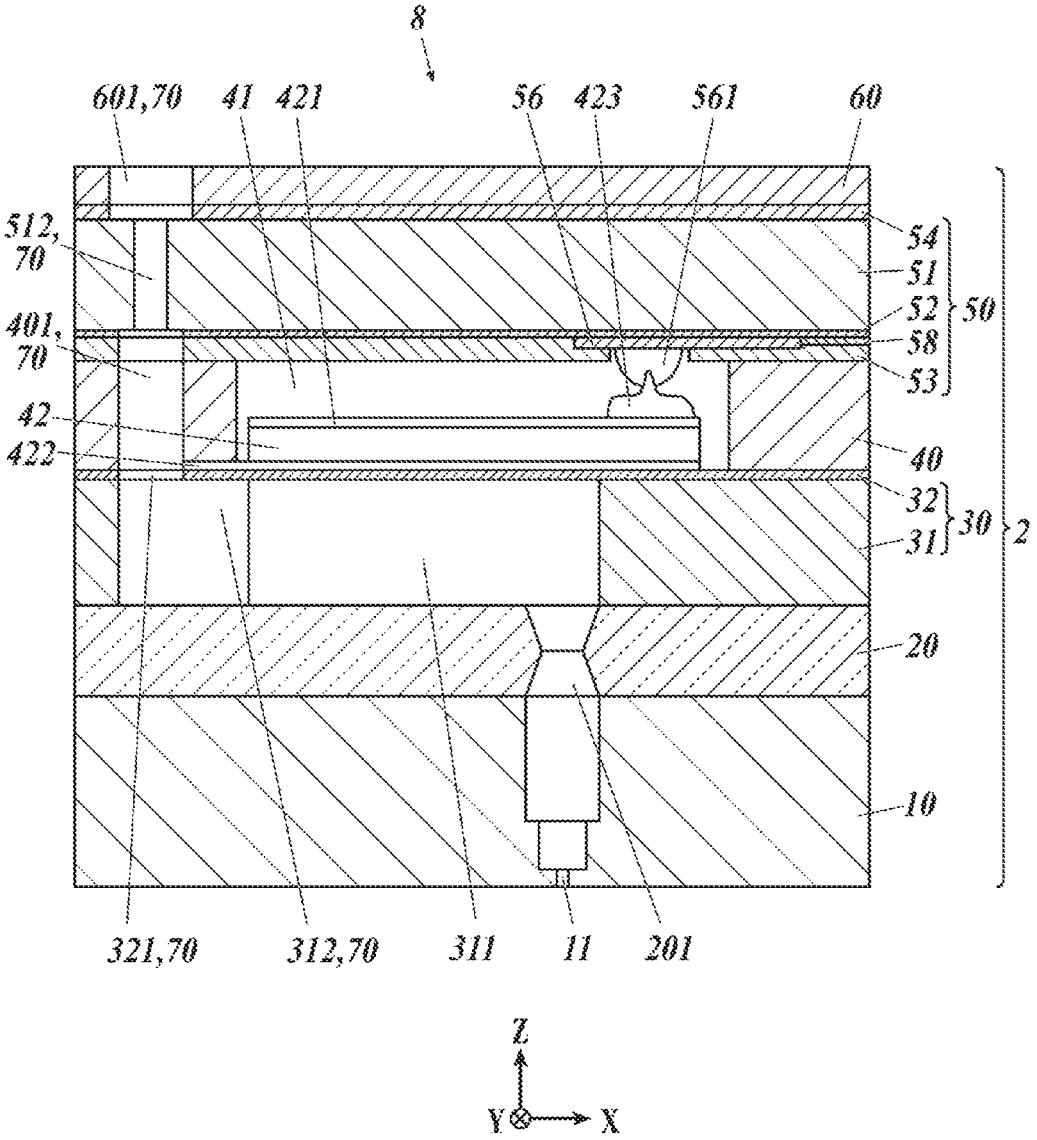
FIG. 8 is a cross-sectional view of an ink ejection unit not including a through electrode.

As illustrated in FIGS. 7 and 8, the ink ejection units 7 and 8 have two different forms: the ink ejection unit 7 includes the through electrode 55 in the wiring substrate 50; and the ink ejection unit 8 does not include the through electrode 55 in the wiring substrate 50.

Note that, in the following description, the ink ejection unit 7 will be described first in detail, and as for the ink ejection unit 8, only a different point from the ink ejection unit 7 will be described later.

Additionally, for convenience of describing a positional relation of the ink ejection unit 7 in the Z direction, the later-described pressure chamber 311, an inlet 512, and the like will be indicated by solid lines in FIG. 9 for description.

As illustrated in FIG. 7, the ink ejection unit 7 has a six-layer structure including a nozzle substrate 10, an adhesive substrate 20, a pressure chamber substrate 30, a spacer substrate 40, a wiring substrate 50, and an adhesive layer 60 in this order from a bottom in the Z direction.

The nozzle substrate 10 is a substrate made of silicon and positioned at a lowermost layer of the ink ejection unit 7. A plurality of nozzles 11 is formed in the nozzle substrate 10, and a lower surface of the nozzle substrate 10 is a surface where the nozzles are formed.

The adhesive substrate 20 is a glass substrate, and stacked and joined to an upper surface of the nozzle substrate 10. In the adhesive substrate 20, formed is a through hole 201 which is in communication with the nozzle 11 of the nozzle substrate 10 and penetrates the adhesive substrate in the Z direction, namely, in a stacking direction.

The pressure chamber substrate 30 is formed of a pressure chamber layer 31 and a vibration plate 32.

The pressure chamber layer 31 is a substrate made of silicon, and stacked and joined to an upper surface of the adhesive substrate 20. In the pressure chamber layer 31, the pressure chamber 311 to apply ejection pressure to an ink to be ejected from the nozzle 11 is formed in a manner penetrating the pressure chamber layer 31 in the Z direction. The pressure chamber 311 is provided above the through hole 201 and the nozzle 11, and is in communication with the through hole 201 and the nozzle 11. Furthermore, in the pressure chamber layer 31, a communication hole 312 that is in communication with the pressure chamber 311 is formed in a manner penetrating the pressure chamber layer 31 in the Z direction while extending in a horizontal direction (refer to FIG. 9).

The vibration plate 32 is stacked and joined to an upper surface of the pressure chamber layer 31 so as to cover an opening of the pressure chamber 311. In other words, the vibration plate 32 constitutes an upper wall portion of the pressure chamber 311. An oxide film is formed on a surface of the vibration plate 32. Additionally, the vibration plate 32 is formed with a through hole 321 which is in communication with the communication hole 312 and penetrates the vibration plate in the Z direction.

The spacer substrate 40 is a substrate formed of a 42 alloy, stacked on an upper surface of the vibration plate 32, and serves as a partition wall layer that forms a space 41 between the vibration plate 32 and the wiring substrate 50. The space 41 is formed above the pressure chamber 311 in a manner penetrating the spacer substrate 40 in the Z direction, and houses the piezoelectric element 42 inside thereof.

Figure 9:
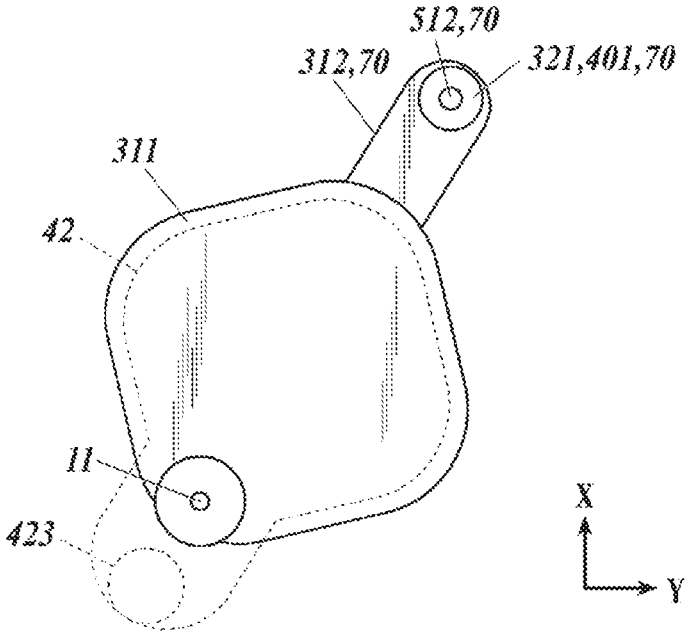
FIG. 9 is a schematic view to describe a structure of a head chip.

The piezoelectric element 42 is formed to have a plan view shape substantially same as the pressure chamber 311 does, and is provided at a position facing the pressure chamber 311 interposing the vibration plate 32 (refer to FIG. 9). The piezoelectric element 42 is an actuator made of lead zirconium titanate (PZT) to deform the vibration plate 32. Additionally, two electrodes 421 and 422 are provided on an upper surface and a lower surface of the piezoelectric element 42 respectively, and the electrode 422 on the lower surface side is connected to the vibration plate 32.

Additionally, in the spacer substrate 40, a through hole 401 which is in communication with the through hole 321 of the vibration plate 32 and penetrates the spacer substrate in the Z direction is formed independently from the space 41.

The wiring substrate 50 includes an interposer 51 that is a silicon substrate. A lower surface of the interposer 51 is covered with two insulation layers 52 and 53 made of silicon oxide, and an upper surface thereof is covered with an insulation layer 54 made of the same silicon oxide. Furthermore, the insulation layer 53 located on a lower side out of the insulation layers 52 and 53 is stacked and joined to an upper surface of the spacer substrate 40.

In the interposer 51, a through hole 511 penetrating the interposer in the Z direction is formed, and the through electrode 55 is inserted through this through hole 511. One end of a third wire 56 made of copper and extending in the horizontal direction is connected to a lower end of the through electrode 55, and a stud bump 423 provided at the electrode 421 on the upper surface of the piezoelectric element 42 is connected to the other end of the third wire 56 via a solder 561 exposed inside the space 41. The first wire 57 is connected to an upper end of the through electrode 55, and the first wire 57 extends in the horizontal direction and is connected to the connecting member 4 (refer to FIG. 3). Furthermore, the third wire 56 is interposed and protected between the two insulation layers 52 and 53 on a lower surface of the interposer 51.

Meanwhile, it is assumed that the third wire 56 is made of copper, but a material can be suitably changed as far as the material is a conductor, and for example, aluminum may also be used.

Additionally, the interposer 51 is formed with the inlet 512 which is in communication with the through hole 401 of the spacer substrate 40 and penetrates the interposer in the Z direction. Meanwhile, respective portions which cover the vicinity of the inlet 512 in the insulation layers 52 to 54 are formed to have opening diameters larger than that of the inlet 512.

The adhesive layer 60 is stacked and joined to an upper surface of the insulation layer 54 of the interposer 51 while covering the first wire 57 arranged on the upper surface of the wiring substrate 50. The adhesive layer 60 is a layer which adheres to the holding portion 90 and is a photosensitive resin layer, and also is a protective layer to protect the first wire 57.

Furthermore, in the adhesive layer 60, an ink supply hole 601 which is in communication with the inlet 512 and penetrates the adhesive layer in the Z direction is formed.

Here, the communication hole 312, through holes 321 and 401, ink supply hole 601, and inlet 512 constitute an individual flow path 70 that provides communication between the ink chamber 3 and the pressure chamber 311.

Next, a structure of the ink ejection unit 8 will be described with reference to FIG. 8. Note that the description will be provided only for the wiring substrate 50 having a structure different from that of the ink ejection unit 7, and other components will be denoted by the same reference signs and descriptions therefor will be omitted.

The wiring substrate 50 includes an interposer 51 that is a silicon substrate. A lower surface of the interposer 51 is covered with two insulation layers 52 and 53 made of silicon oxide, and an upper surface thereof is covered with an insulation layer 54 made of the same silicon oxide. Furthermore, the insulation layer 53 located on a lower side out of the insulation layers 52 and 53 is stacked and joined to an upper surface of the spacer substrate 40.

A third wire 56 extends in the horizontal direction on the lower surface of the interposer 51 and interposed and protected between the insulation layers 52 and 53 on the lower surface of the interposer 51. A stud bump 423 provided at an electrode 421 on the upper surface of the piezoelectric element 42 is connected to one end of the third wire 56 via a solder 561 exposed inside the space 41. Furthermore, the second wire is connected to the other end of the third wire 56, and the second wire 58 extends in the horizontal direction and is connected to the connecting member 4 (refer to FIG. 3).

In the ink ejection units 7 and 8 having the above-described structures, an ink inside the ink chamber 3 is supplied to the pressure chamber 311 through the individual flow path 70. Then, voltage is applied between the electrodes 421 and 422 through the third wire 56 by the first wire 57 or the second wire 58 connected to the connecting member 4 in accordance with a drive signal from the drive unit 5, and the piezoelectric element 42 interposed between the electrodes 421 and 422 is deformed together with the vibration plate 32, and then the ink inside the pressure chamber 311 is pushed and ejected from the nozzle 11.

[Nozzle Arrangement]

As illustrated in FIG. 10, four nozzle forming areas N1 to N4 each having a shape of a parallelogram are formed on the nozzle substrate 10, and the nozzles 11 are arranged in a matrix shape along directions of respective sides of the parallelogram inside each of the nozzle forming areas. Note that, in the following description, a direction parallel to the Y direction in the parallelogram will be defined as a first direction D1, and a direction slightly inclined with respect to the Y direction from the X direction will be defined as a second direction D2.

In the nozzle forming areas N1 to N4, the first direction D1 and second direction D2 are common, in which four areas each having the same size of area are arranged in the X direction, and the same number of nozzles 11 are provided inside the each of the areas. Furthermore, the nozzle forming areas N1 to N4 are arrayed on the nozzle substrate 10 in the order of N1, N3, N2, and N4 from the downstream side in the X direction, and row intervals of the nozzles in the X direction are uniform. Additionally, the nozzle forming areas N1 to N4 are arranged slightly deviated from each other in the Y direction at equal intervals in the order of N1, N2, N3, and N4 toward the downstream side. Furthermore, all of the nozzles 11 provided on the nozzle substrate 10 are arranged in a manner slightly deviated from each other at equal intervals with respect to the first direction D1 (Y direction).

The number of nozzles 11 is: n pieces (for example, n=64) in the first direction D1; and m pieces (for example, m=16) in the second direction D2, and the nozzles are arrayed inside the nozzle forming areas N1 to N4 in predetermined order along the first direction D1 and the second direction D2.

[Wiring in Nozzle Forming Area]

Figure 11:
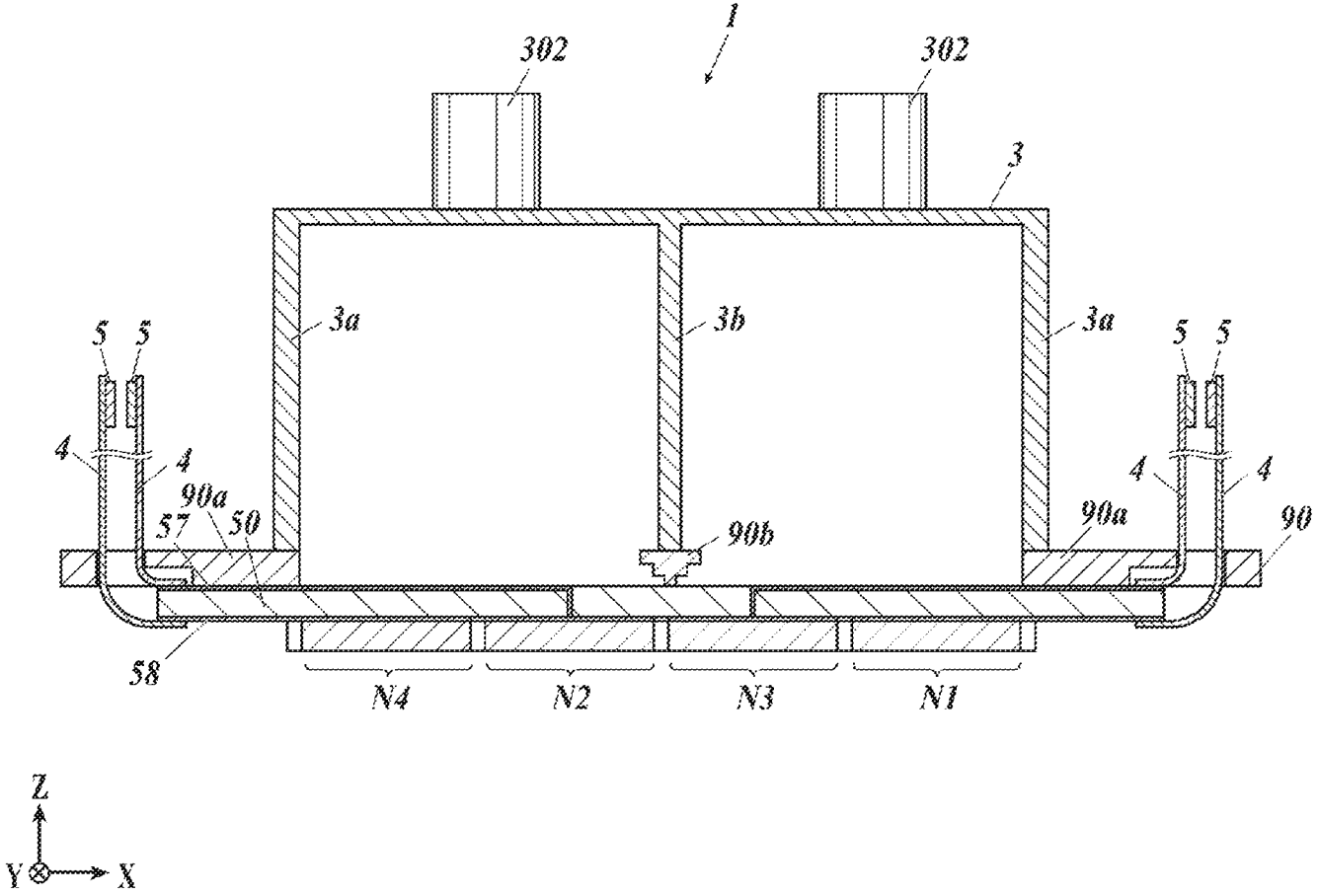
FIG. 11 is a cross-sectional view of an inkjet head illustrating a positional relation in a nozzle forming area.

As illustrated in FIG. 11, arrangement of the nozzle forming areas N1 to N4 in the inkjet head 1 is to arrange the nozzle forming areas in the order of N1, N3, N2, and N4 from the downstream side in the X direction.

Additionally, each of the nozzle forming areas N1 to N4 is wired to an end portion of the wiring substrate 50 located closer to each of the nozzle forming areas, and specifically, N1 and N3 are wired to the downstream side in the X direction and N2 and N4 are wired to the upstream side in the X direction, and then all areas are connected to the connecting member 4 and finally connected to the drive unit 5.

More specifically describing, the nozzle forming areas N1 and N4 are nozzle forming areas provided on the end portion side of the nozzle substrate 10, and are wired from the second wire 58 on the lower surface of the wiring substrate 50, and N1 is wired to the downstream side in the X direction and the N4 is wired to the upstream side in the X direction for connection in FIG. 11. Additionally, the nozzle forming areas N2 and N3 are nozzle forming areas provided on a center portion side of the nozzle substrate 10, and are wired from the first wire 57 on the upper surface of the wiring substrate 50 via the through electrode 55, and N3 is wired to the downstream side in the X direction and N2 is wire to the upstream side in the X direction for connection in FIG. 11.

Meanwhile, for convenience of description, FIG. 11 illustrates a state in which the through electrode penetrates only one place of an upper portion in each of the nozzle forming areas N2 and N3, however; actually, one through electrode 55 is provided for each corresponding nozzle 11, and wiring is provided by the through electrode 55 penetrating the wiring substrate 50 in a manner corresponding to each nozzle 11.

[Inkjet Head of Another Embodiment]

Figure 12:
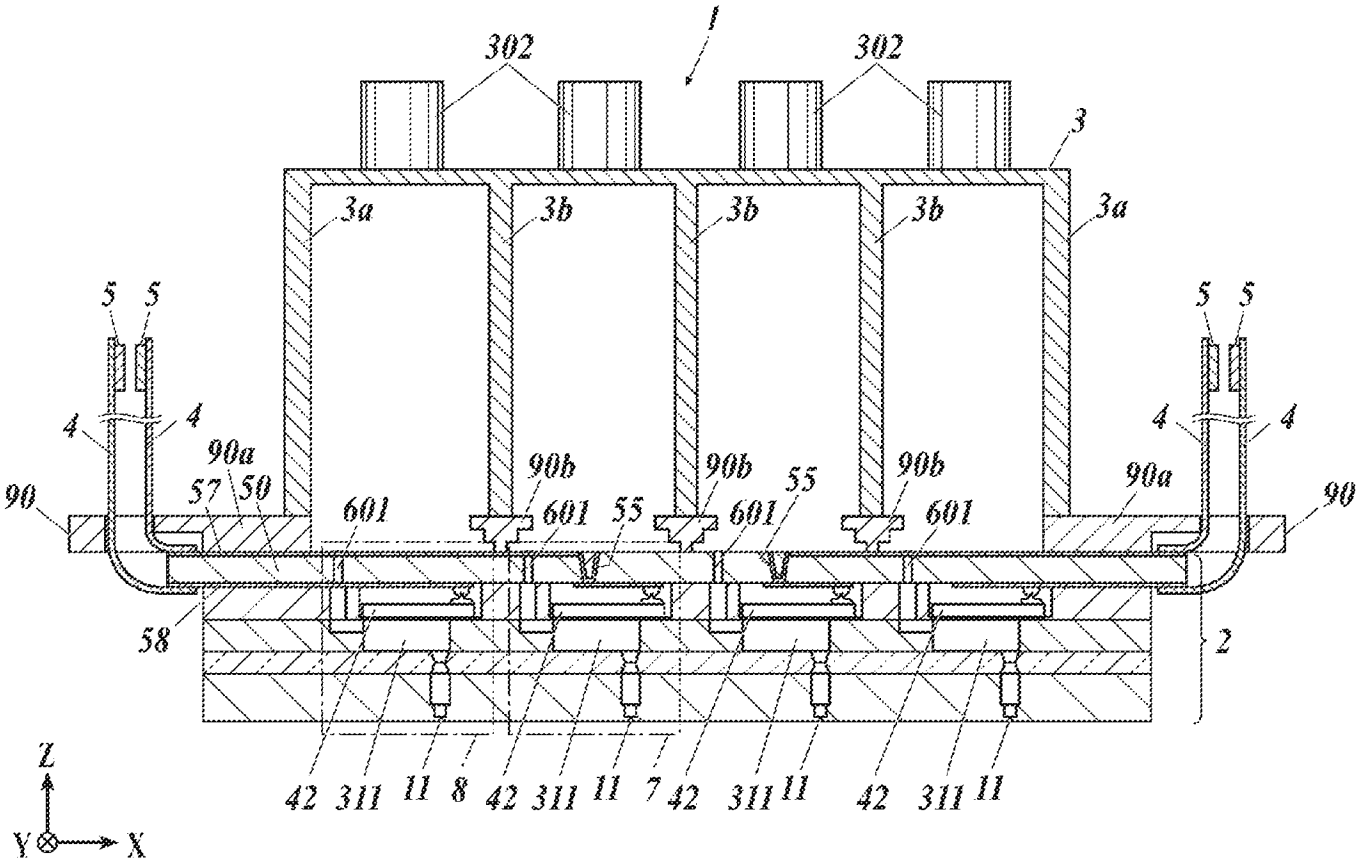
FIG. 12 is a cross-sectional view illustrating a main portion of an inkjet head according to a second embodiment.

Next, another embodiment (second embodiment) in which an ink chamber 3 is separated into four portions will be described with reference to FIGS. 12 to 14. Note that a description for a component similar to the present embodiment will be omitted.

A holding portion 90 of an inkjet head 1 according to the second embodiment includes: an outer peripheral wall holding portion 90*a* to hold an outer peripheral wall 3*a* of the ink chamber 3; and a separation wall holding portion 90*b* to hold three separation walls 3*b* in order to separate the ink chamber 3 into four portions with respect to the X direction.

Figure 13:
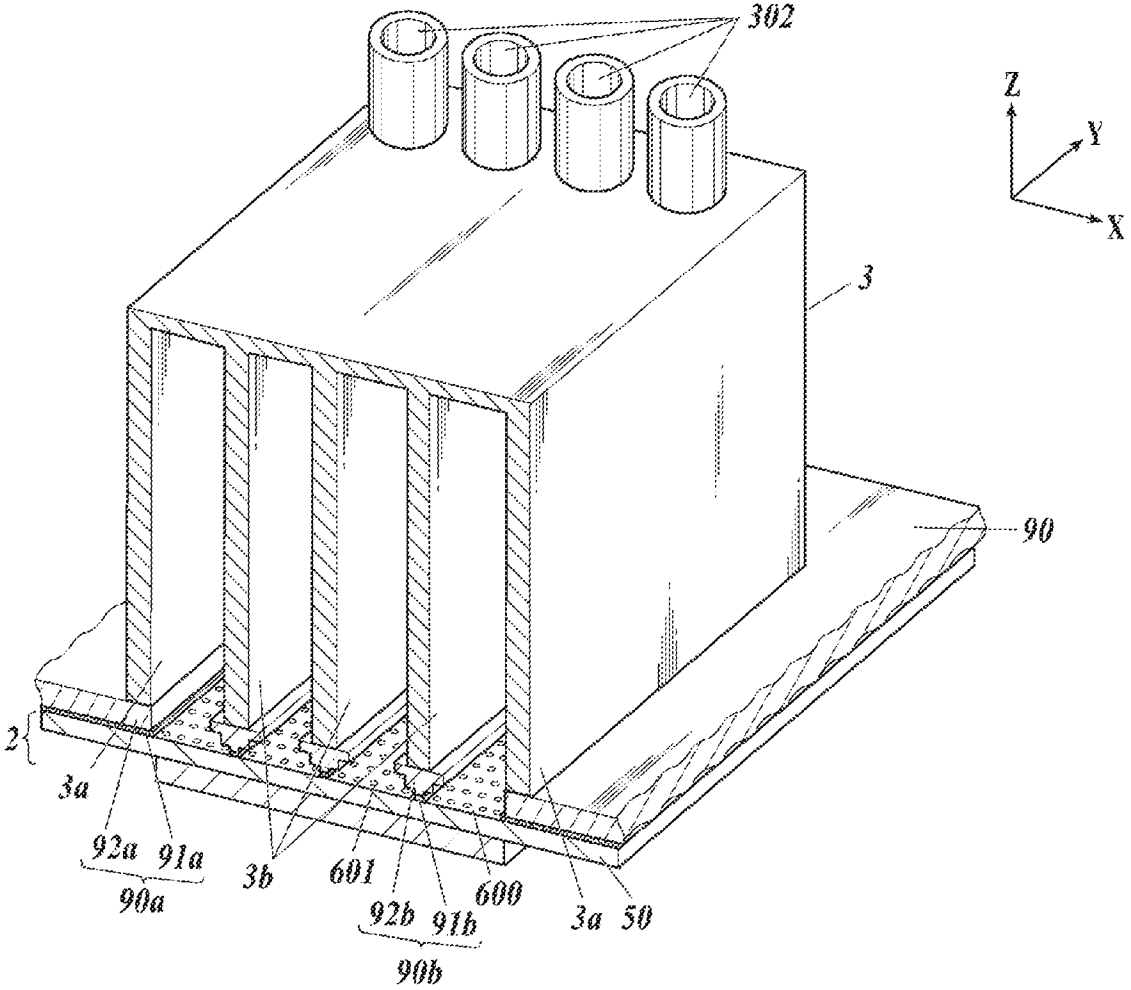
FIG. 13 is a perspective view illustrating a cross section of FIG. 12.
Figure 14:
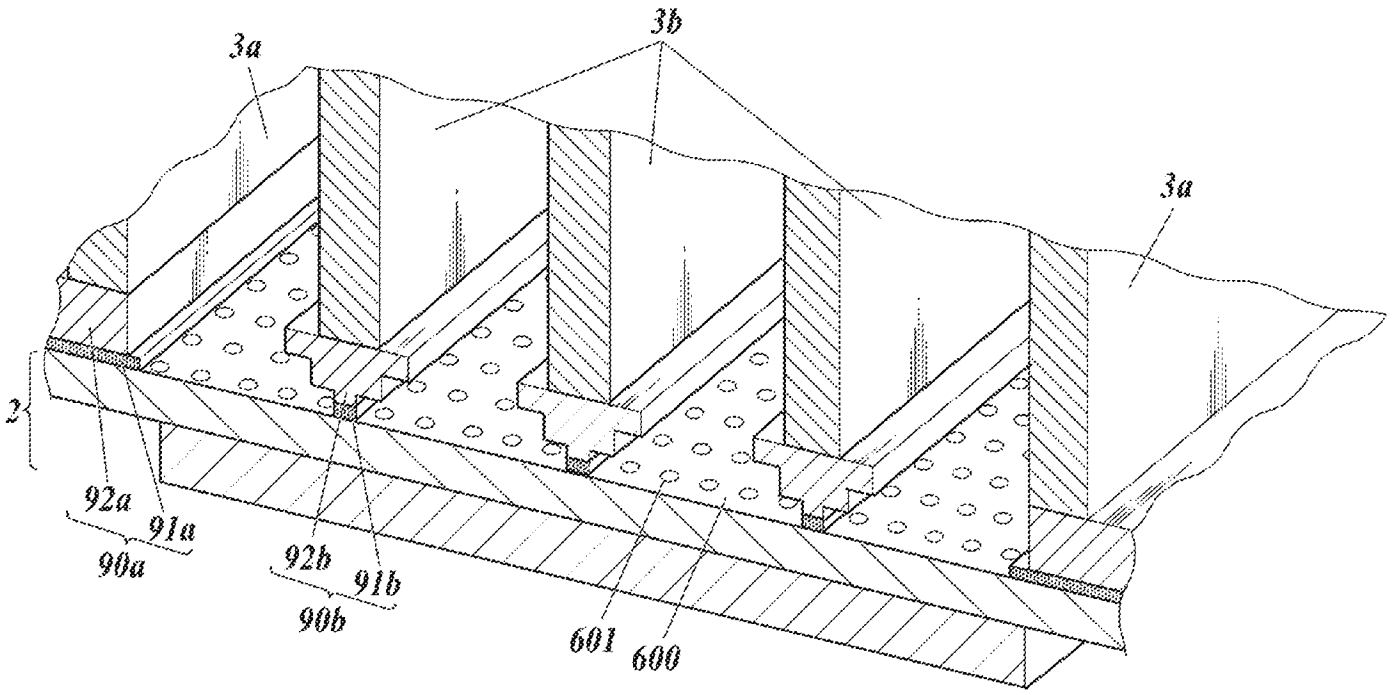
FIG. 14 is an enlarged view of a main portion in FIG. 13.

The outer peripheral wall holding portion 90*a* is formed of: a first spacer portion 91*a* joined to an uppermost surface of a head chip 2 (ink supply hole forming surface 600); and an outer peripheral wall supporting portion 92*a* joined to the first spacer portion 91*a* and supporting the outer peripheral wall 3*a* (refer to FIGS. 13 and 14). Additionally, the separation wall holding portion 90*b* is formed of: a second spacer portion 91*b* joined to the uppermost surface of the head chip 2 (ink supply hole forming surface 600); and a separation wall supporting portion 92*b* joined to the second spacer portion 91*b* and supporting the separation wall 3*b*.

Additionally, the first spacer portion 91*a* and the second spacer portion 91*b* are integrally molded and have a structure including a spacer portion 91 having a uniform height in a Z direction relative to an entire surface of the ink supply hole forming surface 600.

The ink chamber 3 is separated into the four portions by the outer peripheral walls 3*a*, the separation walls 3*b*, and the holding portion 90, and cyan (C), magenta (M), yellow (Y), and black (K) are filled inside the separated portions of the ink chamber 3 color by color. Then, the inks are supplied from the four separated portions of the ink chamber 3 into the pressure chambers 311 provided at ink ejection units 7 and 8 inside the head chip 2 through ink supply holes 601 provided at an uppermost surface of the head chip 2.

[Technical Effects in the Present Invention]

As described above, in the inkjet head 1 of the present invention, the ink chamber 3 is separated into a plurality of portions by the outer peripheral walls 3*a* of the ink chamber 3, a separation wall 3*b* of the ink chamber 3, and the holding portion 90. Additionally, in the head chip 2 of the present invention, the nozzles 11 are arranged on the substrate at the lowermost layer, and the ink supply holes 601 are densely arranged on the substrate at the uppermost layer in order to supply inks to the pressure chambers 311 corresponding to the respective nozzles 11.

The holding portion 90 of the present invention is joined to the uppermost surface of the head chip 2 (ink supply hole forming surface 600), and the holding portion 90 is provided on the upper surface of the head chip 2 by performing position adjustment, and then the outer peripheral wall 3*a* and the separation wall 3*b* of the ink chamber 3 can be provided by using the holding portion 90 as a mark. Therefore, the ink chamber 3 can be separated by a simple structure with high accuracy.

Furthermore, the separation wall holding portion 90*b* is formed in a manner such that the surface joined to the separation wall 3*b* of the ink chamber 3 has the area larger than that of the surface joined to the ink supply hole forming surface 600. Consequently, since the surface joined to the separation wall 3*b* of the ink chamber 3 can be formed larger, reliability of the joined surface can be improved.

Additionally, the separation wall holding portion 90*b* is formed to become larger stepwisely from the surface joined to the ink supply hole forming surface 600 toward the surface joined to the separation wall 3*b* of the ink chamber 3. Consequently, a larger space can be secured in the vicinity of the ink supply hole 601. Therefore, flow path resistance in the vicinity of the separation wall holding portion 90*b* can be prevented from being increased, and pressure applied to an ink supply hole 601 provided near the separation wall holding portion 90*b* and an ink supply hole 601 at a position distant from the separation wall holding portion 90*b* can be uniformly dispersed. Accordingly, it is possible to stably supply inks to all of the ink supply holes 601 from the ink chamber 3.

Moreover, the holding portion 90 of the present invention is formed of: the outer peripheral wall holding portion 90*a* to hold the outer peripheral wall 3*a* of the ink chamber 3; and the separation wall holding portion 90*b* to hold the separation wall 3*b* that separates the ink chamber 3 into a plurality of portions. Here, the outer peripheral wall holding portion 90*a* includes: the first spacer portion 91*a* joined to the ink supply hole forming surface 600; and the outer peripheral wall supporting portion 92*a* joined to the first spacer portion 91*a* and supporting the outer peripheral wall 3*a* of the ink chamber 3. Furthermore, the separation wall holding portion 90*b* includes: the second spacer portion 91*b* joined to the ink supply hole forming surface 600; and the separation wall supporting portion 92*b* joined to the second spacer portion 91*b* and supporting the separation wall 3*b* of the ink chamber 3.

Consequently, the ink chamber 3 can be provided on the upper surface of the head chip 2 with higher accuracy because the first spacer portion 91*a* and the second spacer portion 91*b* are provided on the upper surface of the head chip 2 by performing position adjustment, and then the outer peripheral wall supporting portion 92*a* and the separation wall supporting portion 92*b* are provided by using the first spacer portion 91*a* and the second spacer portion 91*b* as markers, and finally the ink chamber 3 can be provided.

Additionally, the first spacer portion 91*a* and the second spacer portion 91*b* are integrally molded. Consequently, provided is the structure having the uniform height in the Z direction relative to the entire surface of the ink supply hole forming surface 600 that is the upper surface of the head chip 2, and therefore, it is possible to achieve a structure in which ink leakage hardly occurs.

Additionally, position adjustment can be performed with high accuracy by providing an alignment mark in each of the spacer portion 91 and the head chip 2 of the present invention, and joining these component after determining the respective positions. Using such a method of position adjustment, position adjustment having an error level of about ±5 μm can be performed, and position adjustment can be performed with high accuracy for the ink supply hole forming surface 600 including the ink supply holes 601 arranged at a narrow pitch of about 10 μm.

Moreover, the spacer portion 91 has the structure having the thickness thinner than the thicknesses of the outer peripheral wall supporting portion 92*a* and separation wall supporting portion 92*b*. Consequently, position adjustment can be performed with higher accuracy.

Additionally, the ink supply holes 601 are arrayed on the ink supply hole forming surface 600 in a manner corresponding to nozzle arrangement such that respective row intervals in the X direction become equal intervals. In the structure where the ink chamber 3 is separated by the holding portion 90 of the present invention, the row intervals of the ink supply holes 601 can be kept uniform in a manner corresponding to nozzle arrangement because the ink chamber 3 can be separated even without specially making a large space on the ink supply hole forming surface 600 in order to join the separation wall 3*b*.

Therefore, even in the case where the nozzles are densely arranged at uniform row intervals, the ink supply holes 601 can also be densely formed at uniform row intervals in a manner corresponding to the nozzle arrangement. Consequently, a complex structure such as bypassing an ink flow path inside the head chip 2 is not necessary, and the head chip 2 can have a simple structure. Furthermore, there is no need to specially manufacture a head chip 2 for multiple-color use because the ink chamber 3 can be separated by providing the separation wall holding portion 90*b* and the separation wall 3*b* in the head chip 2 for one color use.

[Others]

It should be considered that the embodiments of the present invention disclosed herein are examples in all respects and not restrictive. The scope of the present invention is specified by the scope of claims and not limited to the above detailed description, and intended to include any change within the meaning and the scope equivalent to the scope of claims.

For example, while the embodiments in which the ink chamber 3 is separated into two or four portions in the X direction has been described, the direction and the number of portions into which the ink chambers 3 is separated can be suitably changed.

Also, while the embodiment in which the spacer portion 91 is provided at the holding portion 90 has been described, the structure does not constantly include the spacer portion 91 as far as the ink chamber 3 can be separated by the holding portion 90.

Additionally, a part of the outer peripheral wall 3*a* of the ink chamber 3 may also be formed of a resin member having elastic force. Consequently, inner pressure of the ink chamber 3 can be prevented from being suddenly increased or decreased, and an ink can be stably supplied to the pressure chamber 311 from the ink chamber 3.

Furthermore, as far as the spacer portion 91 is adapted to avoid the ink supply hole 601 and includes the first spacer portion 91*a* joined to the outer peripheral wall supporting portion 92*a* and the second spacer portion 91*b* joined to the separation wall supporting portion 92*b*, the spacer portion 91 can be suitably changed.

Additionally, while it has been described that the nozzles 11 are arranged in the four divided nozzle forming areas each having a parallelogram shape, the shape and the number of nozzle forming areas can be suitably changed, and for example, eight nozzle forming areas may also be provided.

Furthermore, arrangement of the nozzles 11 can also be suitably changed, and for example, the nozzles may be arranged in a manner such that the first direction D1 and the second direction D2 are orthogonal to each other.

Additionally, as far as the first wire 57 and the second wire 58 are adapted to be able to connect the respective piezoelectric elements 42 to respective connection terminals used for connection to the connecting member 4, there is no particular limitation in a wiring method and design can be suitably made. However, since the individual flow path 70 serving as an ink flow path is provided in the wiring substrate 50, it is necessary to provide wiring in a manner avoiding the individual flow path 70.

Additionally, it is assumed that the piezoelectric element 42 is used as a pressure generation unit, but not particularly limited thereto, as far as a mechanism that can eject an ink is provided, a thermal (electrothermal conversion element) may also be used, for example.

INDUSTRIAL APPLICABILITY

The present invention can be utilized in an inkjet head and an inkjet recording device.

REFERENCE SIGNS LIST

1 Inkjet head portion
2 Head chip
3 Ink chamber
3*a* Outer peripheral wall
3*b* Separation wall
11 Nozzle hole
42 Piezoelectric element
90 Holding portion
90*a* Outer peripheral wall holding portion
90*b* Separation wall holding portion
91 Spacer portion
91*a* First spacer portion
91*b* Second spacer part
92*a* Outer peripheral wall supporting portion
92*b* Separation wall supporting portion
100 Inkjet recording device
311 Pressure chamber
600 Ink supply hole forming surface
601 Ink supply hole

The invention claimed is:

1. An inkjet head comprising:

a head chip including: a plurality of nozzles that ejects inks; a plurality of pressure chambers respectively in communication with the plurality of nozzles; and a pressure generation unit that causes the nozzle to eject an ink by generating pressure change inside each of the plurality of pressure chambers;

an ink chamber to store inks to be supplied to the plurality of pressure chambers;

a holder that is joined to an ink supply hole forming surface and holds the ink chamber, the ink supply hole forming surface being formed with an ink supply hole and located on an opposite side of a surface where the plurality of nozzles of the head chip is formed, wherein the holder includes an outer peripheral wall holder that holds an outer peripheral wall of the ink chamber, and a separation wall holder that holds a separation wall of the ink chamber, and the ink chamber is separated into a plurality of adjacent portions by the separation wall and the separation wallholder.

2. The inkjet head according to claim 1, wherein the separation wall holder has a surface joined to the separation wall having an area larger than an area of a surface joined to the ink supply hole forming surface.

3. The inkjet head according to claim 2, wherein the separation wall holder is formed to become larger stepwisely from the surface joined to the ink supply hole forming surface toward the surface joined to the separation wall.

4. The inkjet head according to claim 3, wherein the outer peripheral wall holder includes: a first spacer joined to the ink supply hole forming surface; and an outer peripheral wall supporter joined to the first spacer and supporting the outer peripheral wall, and the separation wall holder includes: a second spacer joined to the ink supply hole forming surface; and a separation wall supporter joined to the second spacer and supporting the separation wall.

5. The inkjet head according to claim 3, wherein the ink supply holes are arrayed on the ink supply hole forming surface in a manner such that respective row intervals become equal intervals.

6. The inkjet head according to claim 3, wherein the plurality of adjacent portions include at least a first ink chamber and a second ink chamber, and an ink stored in the first ink chamber and an ink stored in the second ink chamber are different.

7. An inkjet recording device comprising the inkjet head according to claim 3.

8. The inkjet head according to claim 2, wherein the outer peripheral wall holder includes: a first spacer joined to the ink supply hole forming surface; and an outer peripheral wall supporter joined to the first spacer and supporting the outer peripheral wall, and the separation wall holder includes: a second spacer joined to the ink supply hole forming surface; and a separation wall supporter joined to the second spacer and supporting the separation wall.

9. The inkjet head according to claim 2, wherein the ink supply holes are arrayed on the ink supply hole forming surface in a manner such that respective row intervals become equal intervals.

10. The inkjet head according to claim 2, wherein the plurality of adjacent portions include at least a first ink chamber and a second ink chamber, and an ink stored in the first ink chamber and an ink stored in the second ink chamber are different.

11. An inkjet recording device comprising the inkjet head according to claim 2.

12. The inkjet head according to claim 1, wherein the outer peripheral wall holder includes: a first spacer joined to the ink supply hole forming surface; and an outer peripheral wall supporter joined to the first spacer and supporting the outer peripheral wall, and the separation wall holder includes: a second spacer joined to the ink supply hole forming surface; and a separation wall supporter joined to the second spacer and supporting the separation wall.

13. The inkjet head according to claim 12, wherein the first spacer and the second spacer are integrally molded.

14. The inkjet head according to claim 12, wherein the first spacer and the second spacer are thinner than the outer peripheral wall supporter and the separation wallsupporter.

15. The inkjet head according to claim 12, wherein the first spacer and the second spacer are made of silicon, a 42 alloy, or SUS.

16. The inkjet head according to claim 12, wherein the ink supply holes are arrayed on the ink supply hole forming surface in a manner such that respective row intervals become equal intervals.

17. The inkjet head according to claim 12, wherein the plurality of adjacent portions include at least a first ink chamber and a second ink chamber, and an ink stored in the first ink chamber and an ink stored in the second ink chamber are different.

18. The inkjet head according to claim 1, wherein the ink supply holes are arrayed on the ink supply hole forming surface in a manner such that respective row intervals become equal intervals.

19. The inkjet head according to claim 1, wherein the plurality of adjacent portions including at least a first ink chamber and a second ink chamber, and an ink stored in the first ink chamber and an ink stored in the second ink chamber are different.

20. An inkjet recording device comprising the inkjet head according to claim 1.

* * * * *